US008082680B2

(12) United States Patent
Ives et al.

(10) Patent No.: US 8,082,680 B2
(45) Date of Patent: Dec. 27, 2011

(54) SHOE DEVICE SECURED TO A SYPHON FOR REMOVING CONDENSATE

(75) Inventors: Alan T Ives, Marcellus, MI (US); Gregory L. Wedel, Kalamazoo, MI (US)

(73) Assignee: Kadant Inc., Three Rivers, MI (US)

( * ) Notice: Subject to any disclaimer, the term of this patent is extended or adjusted under 35 U.S.C. 154(b) by 833 days.

(21) Appl. No.: 12/150,429

(22) Filed: Apr. 28, 2008

(65) Prior Publication Data

US 2011/0099856 A1 May 5, 2011

(51) Int. Cl.
*D06F 58/00* (2006.01)

(52) U.S. Cl. ..... 34/124; 34/125; 34/117; 36/3 R; 162/375; 162/358.1; 285/277; 285/279; 165/91; 165/90; 277/306; 277/355

(58) Field of Classification Search ..... 34/110, 34/112, 117, 124, 125, 138, 147, 90; 165/89, 165/90, 91; 36/3 R; 162/375, 358.1; 277/306, 277/355; 285/277, 279
See application file for complete search history.

(56) References Cited

U.S. PATENT DOCUMENTS

| | | | | | |
|---|---|---|---|---|---|
| 2,875,527 | A | * | 3/1959 | Daane | 34/124 |
| 2,978,815 | A | * | 4/1961 | Hieronymus | 34/125 |
| 3,034,225 | A | * | 5/1962 | Hieronymus | 34/125 |
| 3,948,283 | A | * | 4/1976 | Asfura et al. | 137/152 |
| 3,967,386 | A | * | 7/1976 | Asfura | 34/124 |
| 4,498,249 | A | | 2/1985 | Cooke et al. | |
| 4,501,075 | A | | 2/1985 | Jenkner et al. | |
| 4,691,452 | A | | 9/1987 | Ferguson | |
| 4,924,603 | A | * | 5/1990 | Wolf | 34/125 |
| 4,965,920 | A | * | 10/1990 | Smith | 19/258 |
| 5,024,266 | A | * | 6/1991 | Critchlow | 165/89 |
| 5,109,612 | A | * | 5/1992 | Timm | 34/119 |
| 5,230,169 | A | | 7/1993 | Jaatinen et al. | |
| 5,533,569 | A | * | 7/1996 | Reibel et al. | 165/90 |
| 5,864,963 | A | * | 2/1999 | Komulainen | 34/124 |
| 6,203,072 | B1 | * | 3/2001 | Berghuis et al. | 285/24 |

FOREIGN PATENT DOCUMENTS

| | | | | |
|---|---|---|---|---|
| DE | 3412028 | C1 | * | 10/1985 |
| DE | 3535315 | A1 | * | 4/1986 |
| EP | 2113730 | A2 | * | 11/2009 |
| JP | 02014092 | A | * | 1/1990 |
| JP | 04240291 | A | * | 8/1992 |

* cited by examiner

*Primary Examiner* — Stephen M. Gravini
(74) *Attorney, Agent, or Firm* — David J. Archer

(57) ABSTRACT

A shoe device secured to a syphon is disclosed for removing condensate from an internal surface of a rotating cylinder. The shoe device includes a shoe portion which is disposed adjacent to the internal surface of the rotating cylinder. The shoe portion defines a passageway having an upstream and a downstream end. The passageway permits a flow there through of the condensate from the internal surface of the rotating cylinder, through the upstream end of the passageway to the downstream end of the passageway. The shoe portion has a first and a second side, a surface extending between the first and second sides of the shoe portion. The surface is disposed adjacent to the internal surface of the cylinder. The shoe portion also has a leading and a trailing end and a face extending between the leading and trailing ends of the shoe portion. A clamp is secured to a distal end of the syphon and is connected to the shoe portion for clamping the shoe portion to the syphon. An anchor plate is secured to the clamp and is disposed between the shoe portion and the clamp for anchoring the shoe portion.

16 Claims, 2 Drawing Sheets

SHOE DEVICE SECURED TO A SYPHON FOR REMOVING CONDENSATE

BACKGROUND OF THE INVENTION

1. Field of the Invention

The present invention relates to a shoe device secured to a syphon for removing condensate.

More specifically, the present invention relates to a shoe device secured to a syphon for removing condensate from an internal surface of a rotating cylinder.

2. Background Information

The present invention provides an apparatus for removing fluids from a rotating drying cylinder such as but not limited to cylinders used for the drying or cooling of paper. The apparatus consists of a stationary syphon with a fluid passage extending from a position adjacent to the inside surface of the rotating cylinder roll, through a syphon pipe fluid passage that extends from the inside of the rotating cylinder roll, through a hollow journal of the rotating cylinder, and to a rotary joint connected to external stationary piping.

The invention more specifically provides a stationary syphon shoe that is positioned at the end of the fluid passage, adjacent to the inside surface of the rotating cylinder. This syphon shoe is radially adjustable so as to position the stationary syphon with a predetermined gap to the inside surface of the rotating cylinder roll. With suitable pressure differential or cylinder roll rotational speed, the syphon shoe will act to collect condensate from the inside surface of the dryer cylinder and direct the condensate out of the cylinder through the fluid passage. The stationary syphon shoe is supported by a vertical syphon pipe that holds the syphon shoe rigidly above the inside surface of the cylinder and serves as the fluid passage. Typically, the vertical syphon pipe in the prior art is most often a stainless steel pipe. Stainless steel is not susceptible to erosion and corrosion from the action of hot condensate flowing through the pipe. The syphon shoe, according to the present invention has a soft tip facing the inside dryer cylinder roll surface. This soft tip will not damage the dryer if the two come into direct contact. This is a primary object of the present invention. The syphon shoe is constructed such that the radial thickness of the soft tip is larger than 25 mm and preferably larger than 50 mm, such thickness being measured from the radially outermost end to the portion of the syphon shoe that is metallic. The rotating cylinder is used primarily to dry paper, but also can be used for drying, heating or cooling foodstuffs, textiles, and the like, as they pass over the outside surface of the rotating cylinder.

Conventional stationary syphons are either cantilevered from the external rotary joint or are supported by brackets that are either bolted to the dryer journal or to the inside surface of the dryer head. Occasionally, the stationary syphon shoe comes in direct contact with the dryer shell. With conventional stationary syphon shoes, the surface of the rotating dryer shell can be damaged by this contact. This damage can be so severe that the dryer cylinder must be removed or replaced. To minimize the potential for damage, the syphon shoe of the present invention has a soft tip. This soft tip is held in position by a metal clamp pad to the vertical syphon pipe. The soft tip will not damage the inside surface of the cylinder if the two come into direct contact. The clamp pad, on the other hand, would be capable of damaging the shell, so in the present invention, the clamp pad is positioned entirely above the radial outermost end of the vertical syphon pipe. The primary advantage of this invention over the various prior art syphon shoes is the elimination of potential damage to the inside surface of the shell.

Wet paper webs are dried by a series of metal rolls in the paper making process. These rolls are heated by steam that passes through a rotary joint, through the roll journal, and into the inside of the metal roll. The steam is supplied to the rotary joint from fixed, that is, stationary, piping. The steam then goes through the journal of the roll. Once inside the roll, the steam condenses as it transfers its heat to the inside surface of the roll. The condensed steam, that is, water or "condensate", must then be removed so that the roll does not fill up with water. The water is removed through a pipe called a "syphon" by flowing into the syphon pipe, up to the center axis of the roll, and then out of the roll through the syphon pipe that extends through the roll journal. Syphons either turn with the roll, that is "rotary" siphons, or remain fixed with the joint, that is "stationary" syphons.

Stationary syphons that are used to remove condensate are attached to a stationary portion of the rotary joint in order to prevent the syphon from rotating and to seal the inlet flow of steam from the outlet flow of condensate and blow through steam. Conventional stationary syphons are mounted in one of three ways. The most popular method is to use a large cantilevered support tube mounted in the rotary joint and extending through the dryer journal and into the dryer roll. The cantilever tube supports the syphon pipe that extends from the dryer axis to the dryer shell. The tube is stiffer and stronger than standard pipe and can bear the required weight loads and other forces.

The second method of supporting the stationary syphon is to use a large cantilevered support tube that is mounted to the outside end of the journal. The rotary joint can be mounted either to the end of the dryer journal or an external support. In this configuration, the condensate pipe is attached to a stationary portion of the rotary joint and extends through the support tube to the inside of the dryer cylinder. The tube supports the stationary syphon pipe on the inboard end of the support tube, inside the cylinder, typically with carbon bushings. The support tube is larger in diameter, stiffer, and stronger than the condensate pipe and is therefore capable of supporting the syphon weight and associated loading.

The third method of supporting the stationary syphon is a bracket support that is mounted inside the roll where the journal bore terminates inside the roll. The rotary joint can be mounted either to the end of the dryer journal or an external support. In this configuration, the condensate pipe is attached to a stationary portion of the rotary joint and extends through the support tube to the inside of the dryer cylinder. The bracket supports the condensate pipe at the end that is located inside the dryer. The bracket is mounted close to the inboard end of the pipe, to give it proper support. The bracket spins with the roll while the condensate pipe remains stationary, that is, the pipe is not rotating. Carbon graphite or equivalent bushings are used in the bracket to allow relative motion between the bracket and the condensate pipe. The bracket is stiffer and stronger than the condensate pipe and supports most of the loading.

In each of these prior art stationary syphon designs, the radial syphon pipe extends to and is positioned close to the inside surface of the dryer cylinder. To improve the collection of condensate, a special syphon shoe is connected to the end of the vertical syphon pipe, adjacent to the inside surface of the cylindrical roll. This syphon shoe is generally contoured and set so that there is a natural "scoop" action to entrain condensate that is in a rimming condition. The syphon shoe is generally positioned very close to the roll surface, in order to prevent large amounts of condensate from accumulating inside the roll.

Syphon shoes of the prior art have been manufactured from stainless steel castings. The stainless steel does not erode or corrode in service, and hence has provided long service life. There is, however, an increased risk that the stainless steel shoe will damage the inside surface of the cylindrical roll, if they come into contact with each other.

On occasion, however, the support for the stationary syphon pipe is damaged or fails, or for various reasons is displaced from its intended position on the inside of the journal of the roll, such that the syphon shoe contacts the inside surface of the roll. Stainless steel syphon shoes tend to harden when they contact the rotating metal cylinder surface. The hardened stainless steel tends to wear and cut into the cylinder surface, eventually damaging the cylinder, possibly to the point of failure.

To prevent such damage in the event of contact, stationary syphon shoes of the prior art design have alternatively been made from fully-annealed ductile iron or gray iron castings. These materials, however, tend to erode and corrode in service. Yet another prior art solution has been the use a syphon shoe that consists of a metal clamping portion and a soft non-metallic tip adjacent to the dryer surface. In this prior art design, the soft portion of the syphon shoe does not damage the roll surface on contact, but after the soft portion is worn away, the metallic clamping portion can contact the surface and can damage the surface.

The object of the present invention is to have a stationary syphon shoe that can be rigidly positioned in close proximity to the inside surface of a rotating cylinder, with little potential for the syphon shoe to damage the roll surface should they come into contact with each other.

The syphon shoe according to the present invention consists of a stainless steel clamp pad and a soft non-metallic tip. The stainless steel clamp is used to hold the syphon shoe to the stainless steel radial syphon pipe. The tip of the syphon shoe is made from a material that is softer than the inside surface of the roll, a material that does not readily corrode or erode, and one that ideally maintains its rigidity and strength at high operating temperatures.

In the preferred embodiment of this invention, the soft material is PTFE (TEFLON)

The clamp pad according to the present invention holds the syphon shoe to the radial syphon pipe with the entire metallic portion of the clamp being positioned above the end of the stainless steel syphon pipe which means the clamp is radially closer to the roll axis of rotation than the distal end of the syphon pipe.

With the preferred embodiment of the present invention, the soft portion of the syphon shoe can contact the inside surface of the rotating cylinder and experience significant wear, without having the metallic portion of the syphon shoe contacting the roll. In this embodiment, the soft portion of the syphon shoe can wear down until the radial syphon pipe is contacting the inside surface of the cylindrical roll, and yet the metallic portion or clamp portion of the syphon shoe is still not touching or damaging the shell.

The concept of the present invention allows the maximum amount of space between the radial syphon pipe as a wearing allowance, without having any metallic portion that extends below the end of the syphon pipe.

With the preferred embodiment of the present invention, the metallic clamping portion of the syphon shoe is, in operation, entirely above the end of the syphon pipe. The soft portion of the syphon shoe extends from the metallic portion toward the inside surface of the rotating cylinder. The soft tip can contact the inside surface of the rotating cylinder and experience significant wear, without having the metallic portion of the syphon shoe contacting the roll. In this embodiment, the soft portion of the syphon shoe can wear down until the radial syphon pipe is contacting the inside surface of the cylindrical roll, and yet the clamp or metallic portion of the syphon shoe is still not touching or damaging the shell. The thickness of the soft tip is at least 25 mm when measured radially from the portion closest to the cylindrical roll surface and is ideally 50 mm or more.

Further, the front face of the soft tip has an angled profile and a radius that minimizes the impact force of rotating condensate on this face of the stationary syphon shoe, to minimize the forces on the syphon support assembly.

Still further, the bottom of the syphon shoe, that is, the portion facing the surface of the rotating cylindrical roll, has a radius that matches or nearly matches the inside radius of the roll. Still further, the radius of curvature of this surface has its center located offset from the centerline of the radial syphon pipe and still further this offset is located circumferentially on the opposite side of the axis of the radial pipe from the leading end of the syphon shoe.

Moreover, the back face of the syphon shoe, that is the portion opposite the front face, consists of a contour that is generally rounded so as to produce minimal disruption of the condensate that flows around or under the syphon shoe.

The present invention provides an apparatus for removing condensate from the inside of a rotating cylindrically roll such as a drying cylinder of a papermaking machine and the like. The apparatus includes a stationary syphon shoe located near the inside surface of the rotating cylinder shell and connected by a syphon pipe that extends from the syphon shoe through a hollow journal of the cylinder to a rotary joint located outside the cylinder. The syphon pipe is supported by a suitable cantilevered horizontal support tube, an internal bushing in an internal bracket, or an internal bushing in a journal-mounted support tube. The syphon shoe has a soft tip which is characterized by the following:

1. The thickness of the soft tip is at least 25 mm and preferably more than 50 mm.

2. The soft tip extends radially above the radially outermost end of the vertical syphon pipe.

3. The soft tip is attached to a clamp pad with a "T" slot or equivalent mounting.

4. No metallic portion of the clamp pad extends below the radially outermost end of the vertical syphon pipe.

5. The front face of the soft tip has a radius and/or an angled profile so as to minimize the impact forces of the condensate on the syphon assembly.

6. The back face of the soft tip is contoured so as to minimize the disruption of the flow of condensate around or under the syphon shoe.

7. The bottom face of the soft tip has a radius so as to approximate the radius of the inside surface of the cylindrical roll.

8. The center for the bottom face radius is located offset with respect to the centerline of the vertical syphon pipe.

9. The center offset point is located on the circumferentially opposite side of the soft tip front face.

Thus the primary feature of the present invention is to provide a shoe device secured to a syphon that prevents any damage to an internal surface of a cylinder.

Another important feature of the present invention is to provide a shoe device secured to a syphon for extracting condensate from a dryer cylinder of a papermaking machine.

A further important feature of the present invention, is the provision of a shoe device secured to a syphon such that even if the shoe device becomes worn down, the syphon clamp of the shoe device will not contact and damage the internal surface of a dryer cylinder Other features and advantages of the present invention will be readily apparent to those skilled in the art by a consideration of the detailed description of a preferred embodiment of the present invention contained herein.

SUMMARY OF THE INVENTION

The present invention relates to a shoe device secured to a syphon for removing condensate from an internal surface of a rotating cylinder. The shoe device includes a shoe portion which is disposed adjacent to the internal surface of the rotating cylinder. The shoe portion defines a passageway having an upstream and a downstream end. The passageway permits a flow there through of the condensate from the internal surface of the rotating cylinder, through the upstream end of the passageway to the downstream end of the passageway. The shoe portion has a first and a second side, a surface extending between the first and second sides of the shoe portion. The surface is disposed adjacent to the internal surface of the cylinder. The shoe portion also has a leading and a trailing end and a face extending between the leading and trailing ends of the shoe portion. A clamp is secured to a distal end of the syphon and is connected to the shoe portion for clamping the shoe portion to the syphon. An anchor plate is secured to the clamp and is disposed between the shoe portion and the clamp for anchoring the shoe portion. The arrangement is such that in use of the shoe device, the condensate flows through the passageway, through an aperture defined by the anchor plate and through the clamp into the syphon; The shoe portion is fabricated from a material that is softer than the internal surface of the rotating cylinder for inhibiting any wear damage that could otherwise be caused by frictional contact between the shoe portion and the internal surface of the rotating cylinder.

In a more specific embodiment of the present invention, the shoe portion is fabricated from polytetrafluoroethylene.

Moreover, the passageway curves in a direction from the leading end of the shoe portion to the face of the shoe portion. The upstream end of the passageway is of a scoop shaped configuration for scooping the condensate from the internal surface of the cylinder as the internal surface of the cylinder approaches and passes the leading end of the shoe portion so that the condensate flows through the upstream end of the passageway.

Additionally, the first and second side of the shoe portion define a first and second channel respectively. The channels extend between the leading and the trailing ends of the shoe portion, the first and second channels being disposed adjacent to the anchor plate.

Also, the surface of the shoe portion has a curvature which conforms to a radius of curvature of the internal surface of the cylinder.

Furthermore, the radius of curvature is uniform on the entire length of the shoe so that condensate is scooped from the internal surface of the cylinder through the upstream end of the passageway.

Additionally, the trailing end of the shoe portion defines a tail for reducing turbulence of condensate flowing around the first and second sides of the shoe portion.

Also, the face of the shoe portion is of planar configuration.

The clamp includes a first and second saddle portion, the saddle portions encircling the distal end of the syphon. A first fastener extends through the saddle portions and a second fastener is disposed diametrically opposite to the first fastener portion and extends through the saddle portions such that when the fasteners are tightened, the clamp is rigidly clamped to the distal end of the siphon.

Moreover, the anchor plate is connected to the clamp so that the distal end of the syphon is disposed coaxially relative to the aperture defined by the anchor plate.

The anchor plate has a first and a second face, a first and second extremity and an upstream and downstream extremity. The second face of the anchor is planar such that the second face of the anchor plate cooperates with the planar face of the shoe portion.

A first inturned flange extends from the first extremity such that the first flange cooperates with the first channel of the shoe portion for securing the shoe portion to the anchor plate. Additionally, a second inturned flange extends from the second extremity such that the second flange cooperates with the second channel of the shoe portion for securing the shoe portion to the anchor plate.

Furthermore, the trailing end of the shoe portion defines a third channel which is disposed adjacent to the anchor plate. A third inturned flange extends from the downstream extremity such that the third flange cooperates with the third channel of the shoe portion for securing the shoe portion to the anchor plate.

A locking device extends through the anchor plate and into the shoe portion for locking the shoe portion to the anchor plate.

In a specific embodiment of the present invention, a shortest distance from the surface of the shoe portion to the face of the shoe portion is at least 35 mm.

More specifically, the shortest distance from the surface of the shoe portion to the face of the shoe portion is more than 50 mm.

Many modifications and variations of the present invention will be readily apparent to those skilled in the art by a consideration of the detailed description with particular reference to the annexed drawings that show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the views of the drawings.

DETAILED DESCRIPTION OF THE DRAWINGS

Figure 1:
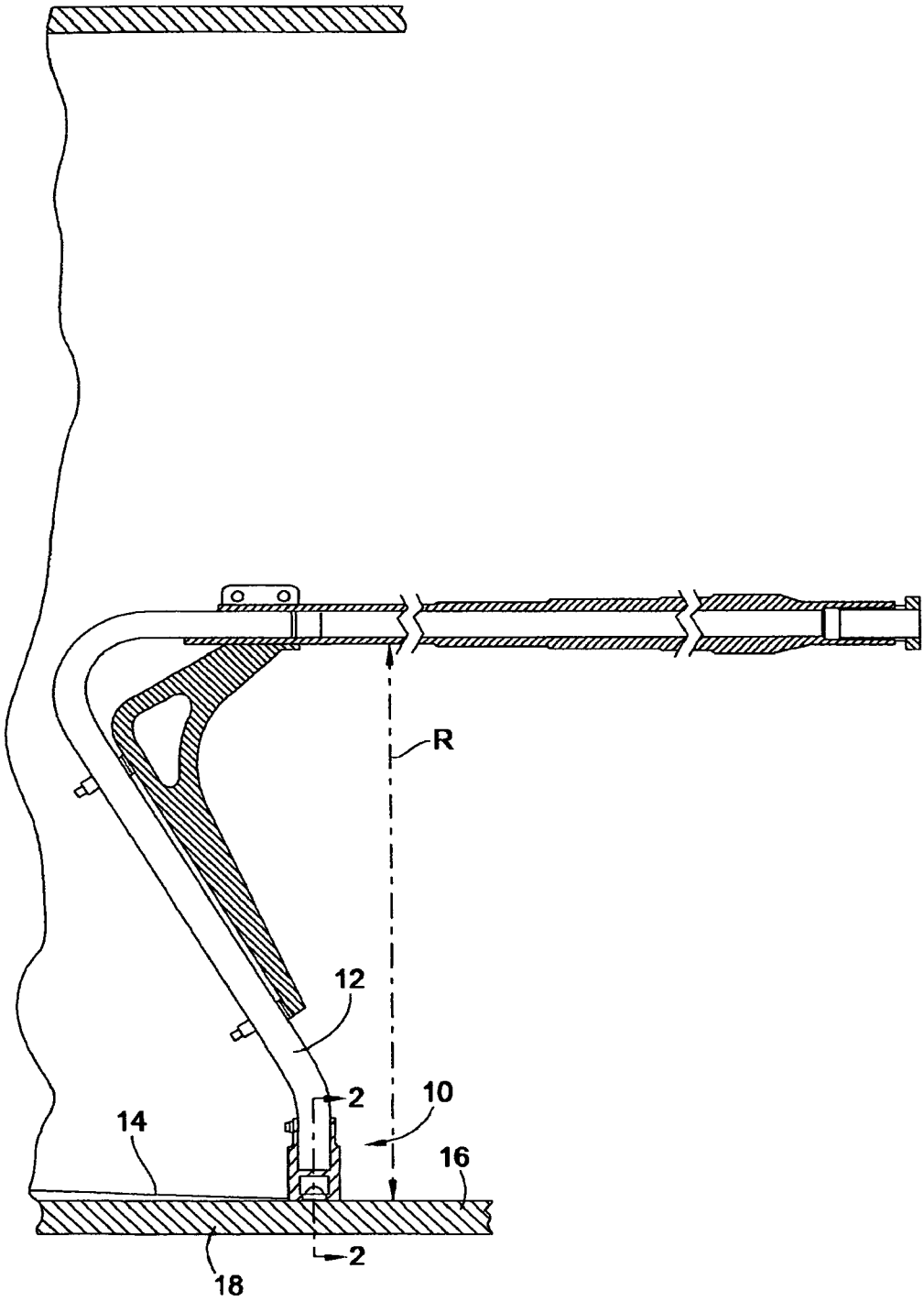
FIG. 1 is a sectional view of a shoe device according to the present invention secured to a syphon for removing condensate from an internal surface of a rotating cylinder.

FIG. 1 is a sectional view of a shoe device generally designated 10 according to the present invention secured to a syphon 12 for removing condensate 14 from an internal surface 16 of a rotating cylinder 18.

Figure 2:
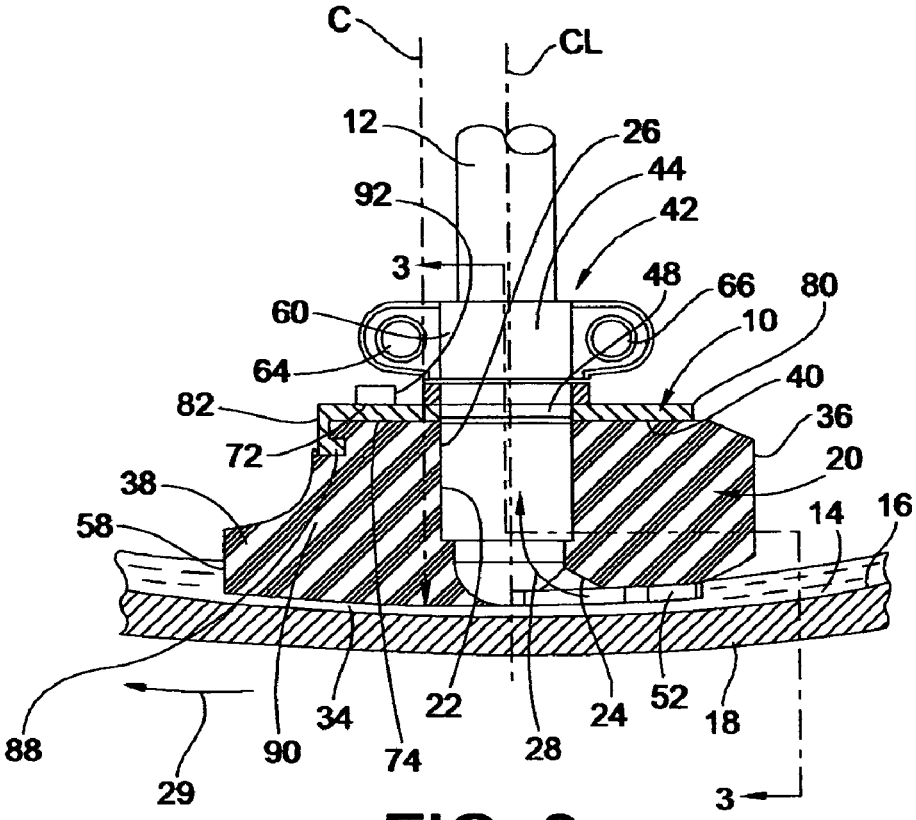
FIG. 2 is an enlarged sectional view taken on the line 2-2 of FIG. 1.

FIG. 2 is an enlarged sectional view taken on the line 2-2 of FIG. 1. As shown in FIG. 2, the shoe device 10 includes a shoe portion generally designated 20 which is disposed adjacent to the internal surface 16 of the rotating cylinder 18. The shoe portion 20 defines a passageway 22 having an upstream and a downstream end 24 and 26 respectively. The passageway 22 permits a flow there through as indicated by the arrow 28 of the condensate 14 from the internal surface 16 of the rotating cylinder 18, through the upstream end 24 of the passageway 22 to the downstream end 26 of the passageway 22. Rotation of the cylinder 18 relative to the stationary syphon 12 is indicated by the arrow 29.

Figure 3:
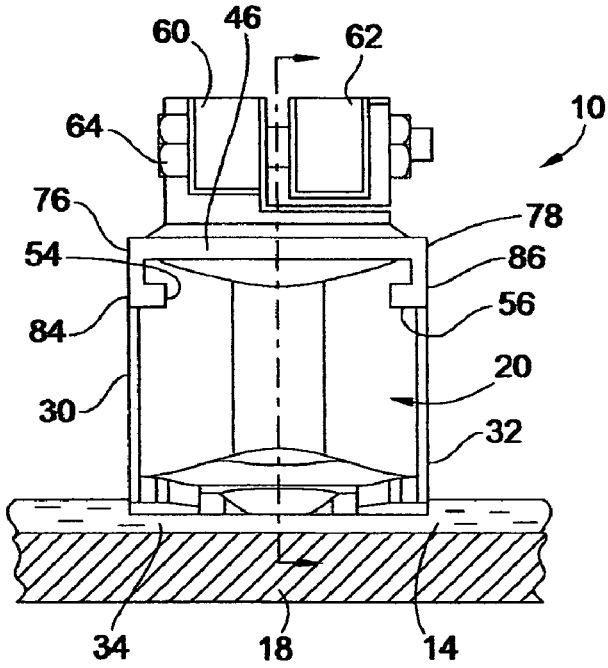
FIG. 3 is an end view of the shoe device taken on the line 3-3 of FIG. 2.

FIG. 3 is an end view of the shoe device 10 taken on the line 3-3 of FIG. 2. As shown in FIG. 3, the shoe portion 20 has a first and a second side 30 and 32 respectively, a surface 34 extending between the first and second sides 30 and 32 of the shoe portion 20. The surface 34 is disposed adjacent to the internal surface 16 of the rotating cylinder 18 as shown in FIG. 2.

As shown in FIG. 2, the shoe portion 20 also has a leading and a trailing end 36 and 38 respectively and a face 40 extending between the leading and trailing ends 36 and 38 of the shoe portion 20. A clamp generally designated 42 is secured to a distal end 44 of the syphon 12 and is connected to the shoe portion 20 for clamping the shoe portion 20 to the siphon 12. An anchor plate generally designated 46 is secured to the clamp 42 and is disposed between the shoe portion 20 and the clamp 42 for anchoring the shoe portion 20. The arrangement is such that in use of the shoe device 10, the condensate 14 flows through the passageway 22, through an aperture 48 defined by the anchor plate 46 and through the clamp 42 into the syphon 12. The shoe portion 20 is fabricated from a material that is softer than the internal surface 16 of the rotating cylinder 18 for inhibiting any wear damage that could otherwise be caused by frictional contact between the shoe portion 20 and the internal surface 16 of the rotating cylinder 18.

In a more specific embodiment of the present invention, the shoe portion 20 is fabricated from polytetrafluoroethylene, that is PTFE which is known as TEFLON. TEFLON is a Registered Trademark owned by E.I. DuPont.

Moreover, as shown in FIG. 2, the passageway 22 curves in a direction as indicated by the arrow 28 from the leading end 36 of the shoe portion 20 to the face 40 of the shoe portion 20. The upstream end 24 of the passageway 22 is of scoop shaped configuration 52 for scooping the condensate 14 from the internal surface 16 of the cylinder 18 as the internal surface 16 of the cylinder 18 approaches and passes the leading end 36 of the shoe portion 20. The arrangement is such that the condensate 14 flows as indicated by the arrow 28 through the upstream end 24 of the passageway 22.

Additionally, as shown in FIG. 3, the first and second side 30 and 32 respectively of the shoe portion 20 define a first and second channel 54 and 56 respectively. The channels 54 and 56 extend between the leading and the trailing ends 36 and 38 respectively of the shoe portion 20. The first and second channels 54 and 56 are disposed adjacent to the anchor plate 46.

Also, the surface 34 of the shoe portion 20 has a curvature C which conforms to a radius of curvature R of the internal surface 16 of the cylinder 18 as shown in FIG. 1.

As shown in FIG. 2, the curvature C of the surface 34 of the shoe portion 20 between the leading end 36 and the trailing end 38 has a first radius of curvature C which is slightly less than the radius of curvature R of the internal surface 16 of the cylinder 18. Also, the syphon 12 has a centerline CL which is offset and parallel relative to the first radius of curvature C.

Additionally, the trailing end 38 of the shoe portion 20 defines a tail 58 for reducing turbulence of condensate 14 flowing around and under the first and second sides 30 and 32 respectively of the shoe portion 20.

Also, the face 40 of the shoe portion 20 is of planar configuration.

The clamp 42 includes a first and second saddle portion 60 and 62 respectively as shown in FIG. 3. The saddle portions 60 and 62 encircle the distal end 44 of the syphon 12 as shown in FIGS. 2 and 3. A first fastener 64 extends through the saddle portions 60 and 62 and a second fastener 66 is disposed diametrically opposite to the first fastener 64 and extends through the saddle portions 60 and 62 such that when the fasteners 64 and 66 are tightened, the clamp 42 is rigidly clamped to the distal end 44 of the syphon 12.

Moreover, the anchor plate 46 is connected to the clamp 42 so that the distal end 44 of the syphon 12 is disposed coaxially relative to the aperture 48 defined by the anchor plate.46

The first and second side 30 and 32 of the shoe portion 20 define the first and second channel 54 and 56 respectively. The channels 54 and 56 extend between the leading and the trailing ends 36 and 38 of the shoe portion 20, the first and second channels 54 and 56 being disposed adjacent to said anchor plate 46;

The face 40 of the shoe portion 20 is of planar configuration. The anchor plate 46 has a first and a second face 72 and 74 respectively, a first and second extremity 76 and 78 respectively and an upstream and downstream extremity 80 and 82 respectively. The second face 74 of the anchor plate 46 is planar such that the second face 74 of the anchor plate 46 cooperates with the planar face 40 of the shoe portion 20.

A first in turned flange 84 extends from the first extremity 76 of the anchor plate 46 such that the first flange 84 cooperates with the first channel 54 of the shoe portion 20 for securing the shoe portion 20 to the anchor plate 46. Additionally, a second in turned flange 86 extends from the second extremity 78 such that the second flange 86 cooperates with the second channel 56 of the shoe portion 20 for securing the shoe portion 20 to the anchor plate 46.

As shown in FIG. 2, the trailing end 38 of the shoe portion 20 defines a third channel 88 which is disposed adjacent to the anchor plate 46. A third in turned flange 90 extends from the downstream extremity 82 such that the third flange 90 cooperates with the third channel 88 of the shoe portion 20 for securing the shoe portion 20 to the anchor plate 46.

A locking device 92 extends through the anchor plate 46 and into the shoe portion 20 for locking the shoe portion 20 to the anchor plate 46.

In a specific embodiment of the present invention, a shortest distance from the surface 34 of the shoe portion 20 to the face 40 of the shoe portion 20 is at least 35 mm.

More specifically, the shortest distance from the surface 34 of the shoe portion 20 to the face 40 of the shoe portion 20 is more than 50 mm.

In operation of the shoe device 10 according to the present invention, as the cylinder 18 rotates as indicated by the arrow 29, condensate 14 is scooped through the upstream end 24 of the passageway 22 for removal thereof through the syphon 12.

In the event of the shoe portion 20 coming into contact with the internal surface 16 of the cylinder 18, no damage will be caused to the internal surface 16 because although PTFE is a tough material, it will not score the internal surface 16 of the cylinder 18. In fact, even if the shoe portion 20 were to become completely worn off by contact thereof with the internal surface 16, the distal end 44 of the syphon 12 would come into contact with the internal surface 16 thus preventing the clamp 42, which is fabricated from stainless steel, from coming into contact with and damaging the internal surface 16.

The present invention provides a unique device for preventing damage to an internal surface of a cylinder that could otherwise be caused by contact between the shoe device and the internal surface.

What is claimed is:

1. A shoe device secured to a syphon which is used for removing condensate from an internal surface of a rotating cylinder, said shoe device comprising:

a shoe portion disposed adjacent to the internal surface of the rotating cylinder, said shoe portion defining a passageway having an upstream and a downstream end, said passageway permitting a flow there through of the condensate from the internal surface of the rotating cylinder, through said upstream end of said passageway to said downstream end of said passageway, said shoe portion having a first and a second side, a surface extending between said first and second sides of said shoe portion, said surface being disposed adjacent to the internal surface of the cylinder, a leading and a trailing end and a face extending between said leading and trailing ends of said shoe portion;

a clamp secured to a distal end of the syphon and connected to said shoe portion for clamping said shoe portion to the syphon;

an anchor plate secured to said clamp and disposed between said shoe portion and said clamp for anchoring said shoe portion so that in use of said shoe device, the condensate flows through said passageway through an aperture defined by said anchor plate and through said clamp into the syphon;

said shoe portion being fabricated from a material that is softer than the internal surface of the rotating cylinder for inhibiting any wear damage to the internal surface of the rotating cylinder that could otherwise be caused by frictional contact between said shoe portion and the internal surface of the rotating cylinder; and said first and second side of said shoe portion defining a first and second channel respectively, said channels extending between said leading and said trailing ends of said shoe portion, said first and second channels being disposed adjacent to said anchor plate for connecting said shoe portion to said anchor plate.

2. A shoe device as set forth in claim 1 wherein said shoe portion is fabricated from polytetrafluoroethylene.

3. A shoe device as set forth in claim 1 wherein said passageway curves in a direction from said leading end of said shoe portion to said face of said shoe portion, said upstream end of said passageway being of scoop shaped configuration for scooping the condensate from the internal surface of the cylinder as the internal surface of the cylinder approaches and passes said leading end of said shoe portion so that the condensate flows through said upstream end of said passageway.

4. A shoe device as set forth in claim 1 wherein said surface of said shoe portion having a curvature which conforms to a radius of curvature of the internal surface of the cylinder.

5. Said curvature of said surface of said shoe portion between said leading and a trailing end having a first radius of curvature which is slightly less than a said radius of curvature of the internal surface of the cylinder;

the syphon having a centerline which is offset and parallel relative to said first radius of curvature.

6. A shoe device as set forth in claim 1 wherein said trailing end of said shoe portion defines a tail for reducing turbulence of condensate flowing around said first and second sides of said shoe portion.

7. A shoe device as set forth in claim 1 wherein said face of said shoe portion is of planar configuration.

8. A shoe device as set forth in claim 1 wherein said clamp includes:

a first and second saddle portion, said saddle portions encircling the distal end of the siphon;

a first fastener extending through said saddle portions;

a second fastener disposed diametrically opposite to said first fastener portion and extending through said saddle portions such that when said fasteners are tightened, said clamp is rigidly clamped to the distal end of the siphon.

9. A shoe device as set forth in claim 1 wherein said anchor plate is connected to said clamp so that the distal end of the syphon is disposed coaxially relative to said aperture defined by said anchor plate.

10. A shoe device as set forth in claim 1 wherein said first and second side of said shoe portion define a first and second channel respectively, said channels extending between said leading and said trailing ends of said shoe portion, said first and second channels being disposed adjacent to said anchor plate;

said face of said shoe portion being of planar configuration;

said anchor plate having a first and a second face, a first and second extremity and an upstream and downstream extremity, said second face of said anchor plate being planar such that said second face of said anchor plate cooperates with said planar face of said shoe portion;

a first in turned flange extending from said first extremity of said anchor plate such that said first flange cooperates with said first channel of said shoe portion for securing said shoe portion to said anchor plate;

a second in turned flange extending from said second extremity of said anchor plate such that said second flange cooperates with said second channel of said shoe portion for securing said shoe portion to said anchor plate;

11. A shoe device as set forth in claim 10 wherein said trailing end of said shoe portion defines a third channel disposed adjacent to said anchor plate;

a third in turned flange extending from said downstream extremity of said anchor plate such that said third flange cooperates with said third channel of said shoe portion for securing said shoe portion to said anchor plate.

12. A shoe device as set forth in claim 1 further including:

a locking device extending through said anchor plate and into said shoe portion for locking said shoe portion to said anchor plate.

13. A shoe device as set forth in claim 1 wherein a shortest distance from said surface of said shoe portion to said face of said shoe portion is at least 35 mm.

14. A shoe device as set forth in claim 1 wherein a shortest distance from said surface of said shoe portion to said face of said shoe portion is more than 50 mm.

15. A shoe device secured to a syphon which is used for removing condensate from an internal surface of a rotating cylinder, said shoe device comprising:

a shoe portion disposed adjacent to the internal surface of the rotating cylinder, said shoe portion defining a passageway having an upstream and a downstream end, said passageway permitting a flow there through of the condensate from the internal surface of the rotating cylinder, through said upstream end of said passageway to said downstream end of said passageway, said shoe portion having a first and a second side, a surface extending between said first and second sides of said shoe portion, said surface being disposed adjacent to the internal surface of the cylinder, a leading and a trailing end and a face extending between said leading and trailing ends of said shoe portion;

a clamp secured to a distal end of the syphon and connected to said shoe portion for clamping said shoe portion to the syphon;

an anchor plate secured to said clamp and disposed between said shoe portion and said clamp for anchoring said shoe portion so that in use of said shoe device, the condensate flows through said passageway, through an aperture defined by said anchor plate and through said clamp into the syphon;

said shoe portion being fabricated a material that is softer than the internal surface of the rotating cylinder for inhibiting any wear damage to the internal surface of the rotating cylinder that could otherwise be caused by frictional contact between said shoe portion and the internal surface of the rotating cylinder.

said clamp including:

a first and second saddle portion, said saddle portions encircling the distal end of the syphon;

a first fastener extending through said saddle portions; and a second fastener disposed diametrically opposite to said first fastener portion and extending through said saddle portions such that when said fasteners are tightened, said clamp is rigidly clamped to the distal end of the siphon, the arrangement being such that even if the shoe portion were to become completely worn off by contact thereof with the internal surface of the cylinder, the distal end of the syphon would come into contact with the internal surface thus preventing the clamp coming into contact with and damaging the internal surface of the cylinder.

16. A shoe device secured to a syphon which is used for removing condensate from an internal surface of a rotating cylinder, said shoe device comprising:

a shoe portion disposed adjacent to the internal surface of the rotating cylinder, said shoe portion defining a passageway having an upstream and a downstream end, said passageway permitting a flow there through of the condensate from the internal surface of the rotating cylinder, through said upstream end of said passageway to said downstream end of said passageway, said shoe portion having a first and a second side, a surface extending between said first and second sides of said shoe portion, said surface being disposed adjacent to the internal surface of the cylinder, a leading and a trailing end and a face extending between said leading and trailing ends of said shoe portion;

a clamp secured to a distal end of the syphon and connected to said shoe portion for clamping said shoe portion to the syphon;

an anchor plate secured to said clamp and disposed between said shoe portion and said clamp for anchoring said shoe portion so that in use of said shoe device, the condensate flows through said passageway through an aperture defined by said anchor plate and through said clamp into the syphon;

said shoe portion being fabricated from a material that is softer than the internal surface of the rotating cylinder for inhibiting any wear damage to the internal surface of the rotating cylinder that could otherwise be caused by frictional contact between said shoe portion and the internal surface of the rotating cylinder;

said shoe portion being fabricated from polytetrafluoroethylene;

said passageway curving in a direction from said leading end of said shoe portion to said face of said shoe portion, said upstream end of said passageway being of scoop shaped configuration for scooping the condensate from the internal surface of the cylinder as the internal surface of the cylinder approaches and passes said leading end of said shoe portion so that the condensate flows through said upstream end of said passageway;

said first and second side of said shoe portion defining a first and second channel respectively, said channels extending between said leading and said trailing ends of said shoe portion, said first and second channels being disposed adjacent to said anchor plate;

said surface of said shoe portion having a curvature which conforms to a radius of curvature of the internal surface of the cylinder;

said curvature of said surface of said shoe portion between said leading and a trailing end having a first radius of curvature which is slightly less than a said radius of curvature of the internal surface of the cylinder;

the syphon having a centerline which is offset and parallel relative to said first radius of curvature.

said trailing end of said shoe portion defining a tail for reducing turbulence of condensate flowing around said first and second sides of said shoe portion;

said face of said shoe portion being of planar configuration;

said clamp including:

a first and second saddle portion, said saddle portions encircling the distal end of the syphon;

a first fastener extending through said saddle portions;

a second fastener disposed diametrically opposite to said first fastener portion and extending through said saddle portions such that when said fasteners are tightened, said clamp is rigidly clamped to the distal end of the siphon;

said anchor plate being connected to said clamp so that the distal end of the syphon is disposed coaxially relative to said aperture defined by said anchor plate;

said first and second side of said shoe portion defining a first and second channel respectively, said channels extending between said leading and said trailing ends of said shoe portion, said first and second channels being disposed adjacent to said anchor plate;

said face of said shoe portion being of planar configuration;

said anchor plate having a first and a second face, a first and second extremity and an upstream and downstream extremity, said second face of said anchor plate being planar such that said second face of said anchor plate cooperates with said planar face of said shoe portion;

a first in turned flange extending from said first extremity of said anchor plate such that said first flange cooperates with said first channel of said shoe portion for securing said shoe portion to said anchor plate;

a second in turned flange extending from said second extremity of said anchor plate such that said second flange cooperates with said second channel of said shoe portion for securing said shoe portion to said anchor plate;

said trailing end of said shoe portion defining a third channel disposed adjacent to said anchor plate;

a third in turned flange extending from said downstream extremity of said anchor plate such that said third flange cooperates with said third channel of said shoe portion for securing said shoe portion to said anchor plate;

a locking device extending through said anchor plate and into said shoe portion for locking said shoe portion to said anchor plate; and a shortest distance from said surface of said shoe portion to said face of said shoe portion being more than 50 mm.

* * * * *